United States Patent [19]

Moore

[11] Patent Number: 4,457,031

[45] Date of Patent: Jul. 3, 1984

[54] MODULAR PRE-PLUMBED SHOWER UNIT

[75] Inventor: John W. Moore, Creve Coeur, Mo.

[73] Assignee: The Swan Corporation, St. Louis, Mo.

[21] Appl. No.: 372,841

[22] Filed: Apr. 28, 1982

[51] Int. Cl.[3] ..... A47K 3/04

[52] U.S. Cl. ..... 4/614; 4/605; 4/191; 52/35

[58] Field of Search ..... 4/638, 567, 570, 596, 4/600, 605, 612, 614, 615, 191, 193; 52/34, 35, 220, 221, 79.1; 248/57

[56] References Cited

U.S. PATENT DOCUMENTS

| | | | |
|---|---|---|---|
| 1,835,301 | 12/1931 | Hennessey | 4/191 |
| 3,005,995 | 10/1961 | Bickford | 4/191 |
| 3,369,261 | 2/1968 | Tiller | 4/191 |
| 3,718,307 | 2/1973 | Albanese | 248/57 |
| 3,978,529 | 9/1976 | Kraft | 4/191 |

FOREIGN PATENT DOCUMENTS

| | | | |
|---|---|---|---|
| 2902550 | 8/1980 | Fed. Rep. of Germany | 4/596 |

*Primary Examiner*—Stephen Marcus
*Assistant Examiner*—Kenneth S. Putnam
*Attorney, Agent, or Firm*—Kalish & Gilster

[57] ABSTRACT

A modular, pre-plumbed shower unit is of self-contained nature facilitating rapid shower installation, and includes a plumbing tree including conduits interconnecting a shower head fixture, a tub spout, and control valve for controlling hot and cold water flow to the shower head or tub spout. Resilient pinch mounting brackets secure the plumbing tree to an exterior wall surface. Water supply connections to the control valve are made outside of the wall through an opening therein. A pre-molded shell is secured to the plumbing tree to surround and conceal the plumbing tree in overlying relationship to the wall while concealing also the wall opening. The shower head fixture, tub spout and a handle for the control valve are connected by openings in the shell.

3 Claims, 9 Drawing Figures

MODULAR PRE-PLUMBED SHOWER UNIT

BACKGROUND AND SUMMARY OF THE INVENTION

This invention relates to showers of the type used in bathrooms and, more particularly, to a shower unit of pre-plumbed nature for facilitating rapid shower installation in existing and newly constructed residences.

Conventionally, showers for residential use, including homes, rental units, condominiums, as well as hotels and motels, have typically involved with the provision of plumbing within a wall surrounding a bathtub. Consequently, it is conventional practice to install plumbing for a shower before the walls surrounding a bathtub are finished. This requires coordination between plumbers and carpenters so that plumbing can be scheduled before finishing. Then, subsequent to the walls being finished, plumbing fixtures are then installed. This requires a greater expense and imposes more difficulty than would be the case if the shower could be installed after the walls are finished.

Additionally, a problem is encountered when it is desired to install a shower in existing construction where one has not previously been in place, as in older residences in which there exists only a tub. This has heretofore required removing or opening major portions of the wall surrounding the tub, installing the requisite plumbing, and then refinishing the wall. The resultant wall repairs are costly, cumbersome and time-consuming. This also usually requires the services of skilled individuals such as professional plumbers or carpenters, plasterers and so forth as may be required to refinish the wall.

When it is desired to replace or repair an existing shower, similar problems are encountered since the existing shower lining or so-called surround may have to be removed or even destroyed to gain access to a wall which itself must then be removed or broken into over a major area to open up the framing in which the plumbing is to be installed. Here again, costly wall repairs, finishing and so forth are required.

As an alternative, unsightly add-on arrangements have been used in which the shower plumbing is simply installed exterior of the wall and extends upwardly to the shower head. But, such arrangements are unattractive, crude in appearance and as a result have not been acceptable.

Accordingly, it is an object of the present invention to provide a pre-plumbed shower unit of modular, self-contained nature for facilitating rapid shower installation.

Another object of the invention is the provision of such a shower unit which is designed for extremely facile, simple installation not only in existing buildings but also in those which are newly constructed.

A further object of the invention is the provision of such a shower unit which can be installed over any flat wall surface or tub surround without requiring costly wall repairs.

Yet another object of the invention is the provision of such a shower unit which can be used to add a shower to a tub which does not have a shower, as well as permitting the replacement of an existing shower.

Yet another object of the invention is the provision of such a shower unit which allows interconnection with existing plumbing without the need for covering over or closing off access openings through which connection is made.

It is also an object of this invention to provide such a shower unit which can be installed by relatively unskilled individuals and without requiring the services of skilled professional such as plumbers, carpenters, plasterers and so forth.

It is also an object of the present invention to provide such a shower unit which conceals and encloses old plumbing attractively to provide an appearance which will complement a bathroom and provide a styled, modern appearance which is in keeping with contemporary decor and so will enhance the beauty of existing facilities and improve their value.

Among other objects of the invention are the provision of such a shower unit which not only maintains the integrity of existing walls but also is itself of sturdy, extremely long-lasting and durable construction; which is economically and relatively simply constructed to provide for low cost to the consumer; and which will protect walls and structure of existing facilities from water damage, leakage, and the like.

Other objects will be in part apparent and in part pointed out hereinbelow.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
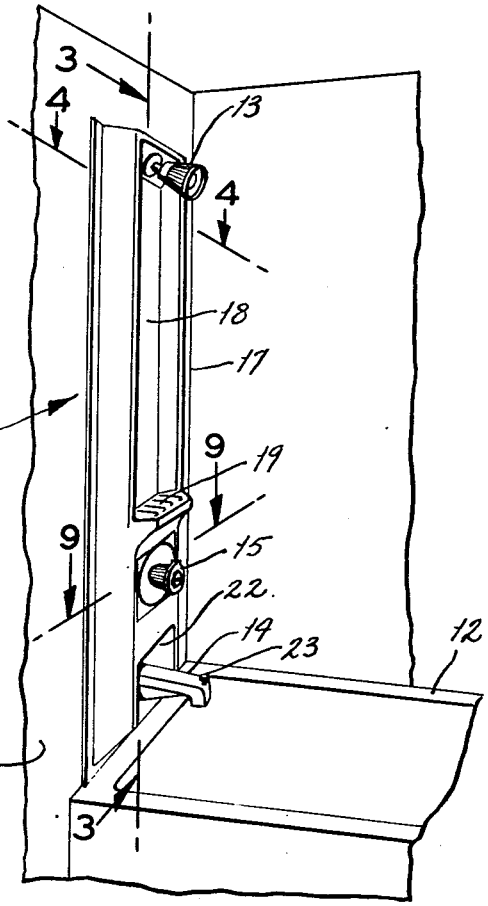
FIG. 1 is a perspective view of a modular, pre-plumbed shower unit constructed in accordance with and embodying the present invention, and illustrating the unit as installed in conjunction with a bathtub.

Referring now to the drawings and particularly to FIG. 1, a modular, pre-plumbed shower unit of the invention is designated generally 10, being illustrated as it appears when installed in a bathroom. Unit 10 is depicted as being affixed to a wall 11 above bathtub 12 to provide a shower head 13 or other shower fixture (such as for connection of a hand shower fixture at the end of a flexible hose). Unit 10 also provides a tub spout 14 and a blender, or control, valve handle 15 for water temperature control. The shower fixture, tub spout and control handle extend outwardly from the front of a pre-molded shell 17 which conceals plumbing of the new unit to be described.

Figure 3:
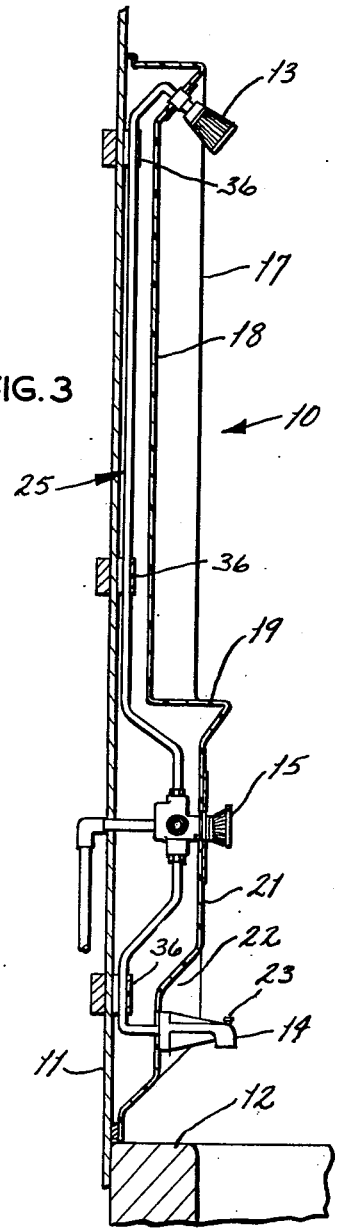
FIG. 3 is a vertical cross-section taken generally along line 3—3 of FIG. 1, showing the unit as installed.

Referring also to FIG. 3, shell 17 is of one-piece configuration to provide not only sculpted appearance of contemporary style for blending harmoniously with modern bathroom decor but also highly useful functions including the provision of an elongated recess 18 extending from shower fixture 13 and terminating in an integrally formed soap dish or ledge 19 proximate control handle 15. The latter is presented conveniently at the front of a prominence 21, below which a shorter downwardly opening recess 22 is provided in which tub spout 14 is located. As is conventional, spout 14 includes a diverter button 23 enabling the user to select shower operation. Recess 18 readily accommodates soap-on-a-string, brushes, various bathing accessories, shampoo containers and so forth while also partly obscuring these items from side view.

Figure 2:
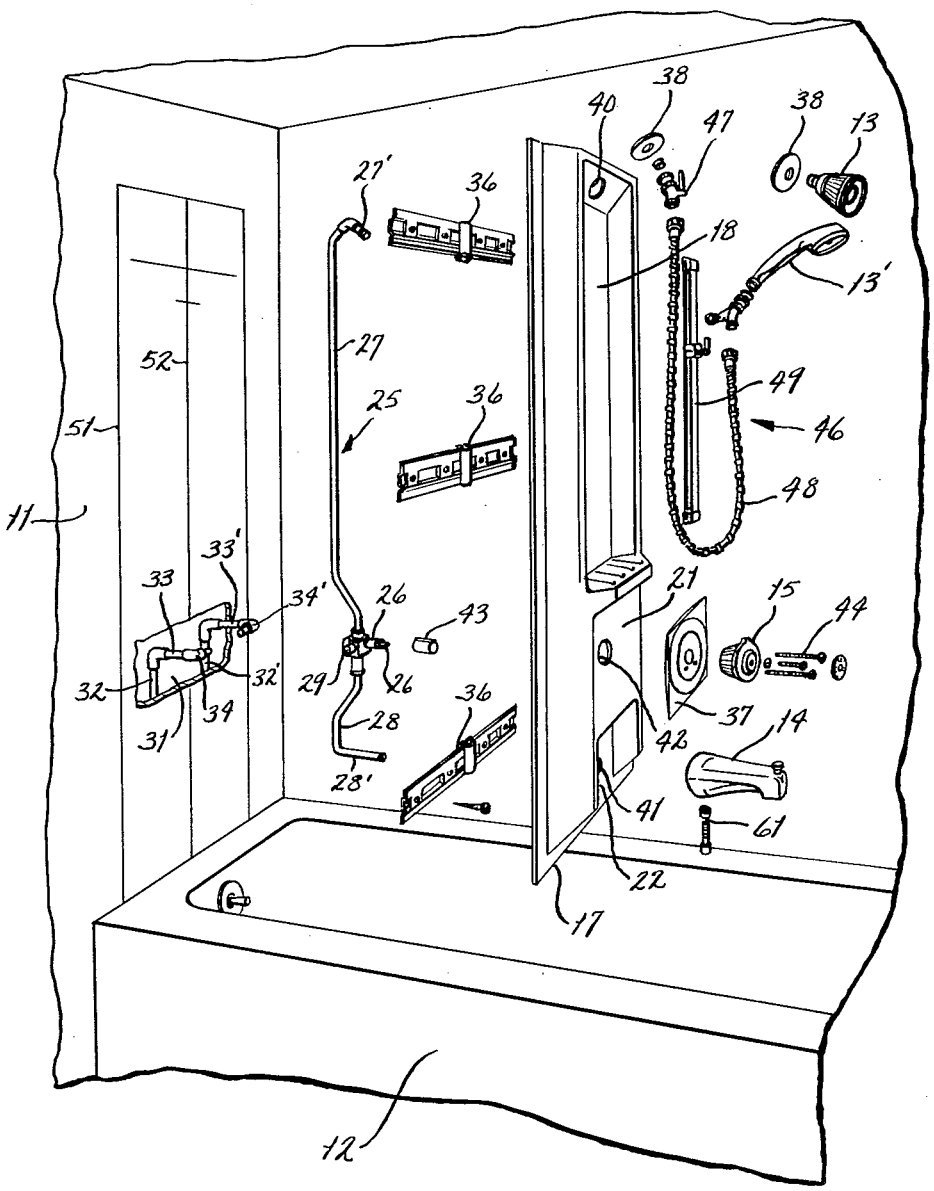
FIG. 2 is an exploded perspective view illustrating the various components of the new unit and illustrating also the interconnection and installation of the new unit.

Referring now to FIG. 2, unit 10 in exploded view includes, in addition to shell 17, a so-called plumbing tree, generally 25, comprising the control valve, designated 26, from which extend upper and lower conduits 27, 28 for respective connection of shower fixture 13 and tub spout 14. Valve 26 contains on opposite sides water inlets, as at 29, for connection of water lines. In this view, wall 11 is shown with an opening 31 having been made therein for obtaining access to the usual hot and cold water lines 32, 32'. In preparation for installation of unit 10, extensions 33, 33' with elbows 34, 34' have been connected to lines 32, 32' so that connection to valve 26 can be made from outside of wall 11.

Also forming part of unit 10 are so-called pinch mounting brackets 36 by which tree 25 is to be attached to wall 11. Unit 10 additionally includes an escutcheon 37, 38 for handle 15 and fixture 13. Conduits 27, 28 have respective outwardly extending portions 27', 28' which will, of course, extend through corresponding apertures 40, 41 of shell 17 when it is in place. Similarly, the shell includes an aperture 42 for receiving the stem 26' of blender valve 26, there being a sleeve 43 for stem 26' which will be retained when escutcheon 37 is installed and secured by screws 44.

FIG. 2 serves to illustrate an alternative personalized shower assembly, generally designated 46, including a shower arm mounting fixture 47 for installation in lieu of shower head 13. A flexible hose 48 permits connection to fixture 47 of a hand shower 13' which may be attached to or detached from a guide rail 49 which conveniently may be secured within recess 18.

Shell 17 is molded preferably of fiberglass to provide a durable, shiny finish, much like that of vitreous enamel, being also strong and resistant to breakage. Of course, other materials may be used such as thermoplastics or other synthetic resin materials, including various polymers, copolymers (such as ABS) and so forth.

Other features of the invention are best illustrated by a description of the installation of the shower unit. The new unit allows for rapid installation by simple connection exteriorly of a wall, in contrast with the customary shower which necessitates the installation of plumbing interiorly of a wall with consequent need to open large areas of a wall or gain access from behind the wall, as by entrance through other wall structure. FIG. 2 demonstrates that a very limited access aperture 31 may be cut into wall 11 to gain access to the hot and cold water service lines 32, 32', being no larger than necessary to permit these lines to be directed outwardly as by the conventional use of elbows so that extensions 33, 33' will be located on opposite sides of valve 26.

Prior to cutting hole 31, it is preferred to locate shell 17 preliminarily adjacent wall 11 in alignment with the longitudinal center line of tub 12. A line 51 may then be traced around the periphery of shell 17 and a center line 52 drawn to establish a reference for the alignment of plumbing tree 25. Hole 31 is cut to remain within the confines thus established by line 51.

Figure 5:
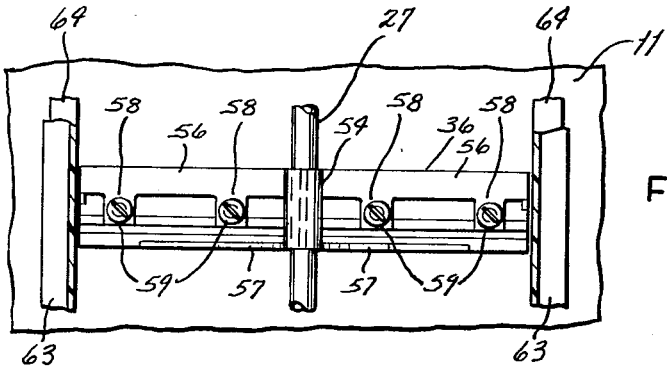
FIG. 5 is an enlarged elevation of a mounting arrangement for the new unit.
Figure 6:
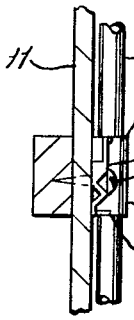
FIG. 6 is an enlarged fragmentary vertical cross-section of the mounting arrangement of FIG. 5.
Figure 4:
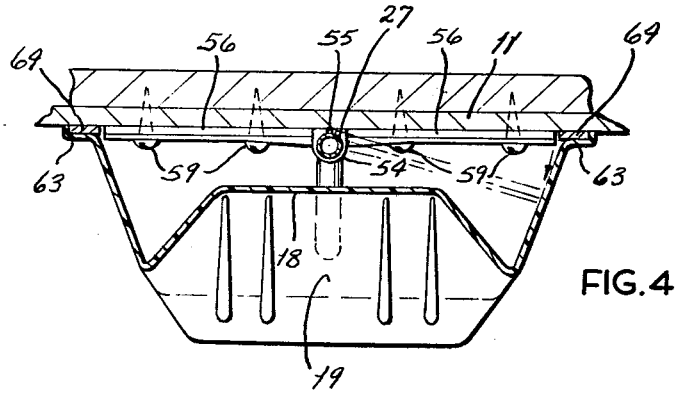
FIG. 4 is an enlarged horizontal cross-section taken generally along line 4—4 of FIG. 1.

Mounting brackets 36 are then utilized to install plumbing tree 25 in alignment with the center line 52. As shown in FIGS. 4–6, each such bracket 36 has a central channel-defining portion 54 for receiving the respective conduits 27, 28 which extend above and below valve 26. Each bracket 36 is formed preferably of molded polyurethane to provide a strong yet highly resilient nature. It will be observed from FIG. 4 that the central portion 54 of the bracket is formed with a notch which extends the height of the bracket. Extended on opposite sides from portion 54 are lateral extensions 56 each having reinforcement flanges, as at 57, as well as increased thickness portions 58 in which are located apertures for receiving screws 59 for securement to wall 11. Because of the resilient nature of the synthetic resin material, i.e., polyurethane, one such portion 56 can be first secured to the wall and the other portion may then be pulled outwardly from wall 11 by bending about central portion 54 which thus serves as a hinge. Such bending opens recess 55 to provide sufficient width for the diameter of the respective conduit 27 or 28. Then, the portion 56 which has been drawn back from wall 11 may be released and the resilient nature of the material will cause the outwardly pulled portion 56 to return to a position of alignment shown in FIG. 4 lying against wall 11 to cause central portion 54 to resiliently and grippingly engage the conduit and so securely retain it in the position not only aligned with central line 52 but also held at the proper vertical location, all as shown in FIG. 4.

With plumbing tree 25 securely positioned as just described, a routine and conventional connection of elbows 34, 34' to valve 26 is quickly made from a location exteriorly of the wall and without difficulty or high plumbing skill, being instead of an entirely routine, simple nature which homeowners and unskilled repairmen may possess.

Shell 17 is now placed over plumbing tree 25 by allowing tub spout extension 28', control valve extension 26' and shower head extension 27' to extend through the corresponding apertures 41, 42 and 40. An escutcheon 38 is fitted over extension 27'. Shower head 13 or fitting 47, as appropriate, is then installed. Similarly, escutcheon 37 is installed and control handle 15 is fitted in place. Screws 44 maintain escutcheon in place.

Figure 7:
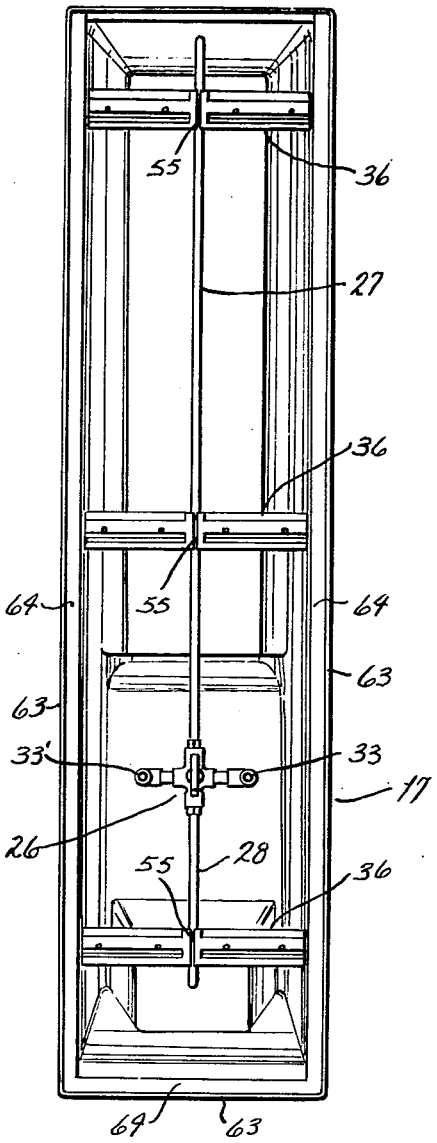
FIG. 7 is a rear elevation of the new unit.
Figure 8:
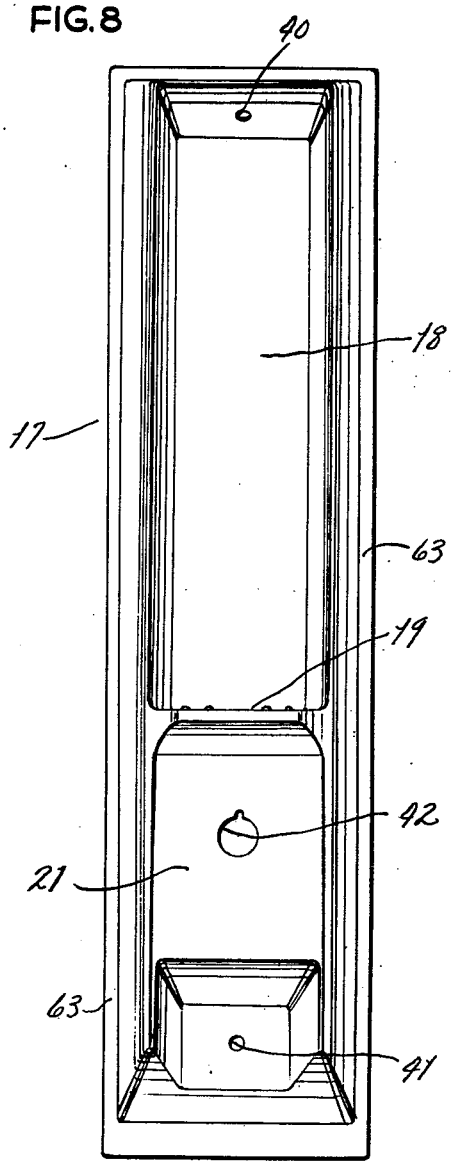
FIG. 8 is a front elevation of the new unit.
Figure 9:
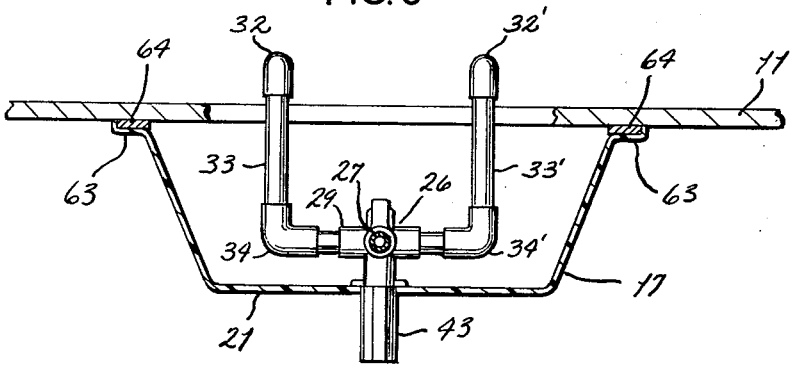
FIG. 9 is an enlarged horizontal cross-section, as taken along line 9—9 of FIG. 1, and showing plumbing interconnection of the new unit with water supply lines.

Similarly, tub spout 14 is fitted over extension 28' and a set screw 61 is tightened to lock spout 14 in place. These fittings provide sufficient pressure to maintain shell 17 in place and cause it to be pressed tightly against wall 11. As demonstrated in FIGS. 7–9, shell 17 is provided with a flanged edge 63 around its periphery and secured to which is a continuous strip 64 of foam-like resilient seal material for providing a wall-conforming water resistant sealing relationship between shell 17 and wall 11 extending completely around the entirety of the periphery of shell 17. It is apparent that the plumbing tree 25 and the other units making up the plumbing assembly are, in effect, used to secure shell 17 to wall 11 by the use of bracket 36 without the need for extrinsic structure.

As installed, shell 17 thereby surroundingly encloses plumbing tree 25 in overlying relationship of the shell to wall 11 as well as conceals wall opening 31, which need not be closed and, on the contrary, is desirably left open in the event that plumbing repairs should ever be made.

Accordingly, observe that unit 10 constitutes a departure from existing concepts in bath fixtures, being designed for extremely easy, facile installation by individuals not possessed of high skill, such as the ordinary homeowner, and eliminates the need for costly wall repairs heretofore required. Shell 17 provides an attractive finished exterior of the unit to provide a highly useful grouping of shower functions and also serves to complement modern styling. Additionally, the new unit maintains the integrity of existing walls and does not require cutting through main structural members, as well as obviates the need for lath work, refinishing, plastering, painting, or the like.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A modular shower unit of pre-plumbed, preconnected character for wall securement for permitting ready interconnection of the shower unit with pre-existing plumbing internal of the wall and to which access may be secured through the wall, said shower unit providing for the connection of said pre-existing plumbing to both a shower head fixture and a tub spout of said modular shower unit, said modular shower unit comprising:

a single, one-piece integral shell enclosure defining within it a concealed vertically elongated cavity lying adjacent the wall, the cavity extending the length between the shower head fixture and tub spout, the shell enclosure including a closed periphery for bearing against the wall at all points completely around the full extent of the periphery for closing and concealing the cavity by adjacency to the wall, and for concealing within the cavity a plumbing assembly providing said plumbing interconnection externally of said wall;

the plumbing assembly including:

(a) a control valve having a control knob securement means;

(b) means for securing the control valve to the enclosure within the cavity in spaced relationship to the wall and with the control knob emerging from the front of the enclosure;

(c) the shower head fixture, which shower head fixture emerges from the enclosure at its upper end;

(d) a first conduit extending upward within the recess from the valve and interconnecting the shower head fixture and the valve;

(e) the tub spout, which tub spout emerges from the enclosure at its lower end;

(f) a second conduit extending downward within the recess from the valve and interconnecting the tub spout and the valve; and (g) means at opposite sides of the valve for direct connection of the valve to the pre-existing plumbing within the wall through access made through the wall rearwardly of, and concealed by, the enclosure, such connection being within and fully concealed by the cavity;

the entirety of the plumbing assembly being contained within the cavity, securement means associated with the enclosure and operatively interconnected with elements of the modular shower unit for mounting of the enclosure upon the wall and for pressing the enclosure against the wall; and a resilient seal extending fully around the periphery of the shell and interposed between the periphery and the wall for providing a wall-conforming water-resilient sealing relationship between the enclosure and the wall;

the enclosure defining within its front, outer surface a vertically-elongated recess extending below the shower fixture but terminating above the control valve in a ledge serving as a soap dish, the recess having forwardly extending side edges for obscuring shower items such as placed within the recess and having also a rear surface spaced outwardly from the wall.

2. A modular shower unit as set forth in claim 1 wherein said plumbing assembly comprises:

(a) an integral plumbing tree including the valve and the first and second conduits preconnected to the valve and being installable as a separate entity;

(b) the securement means comprising a plurality of mounting brackets each formed of resilient synthetic resin material and including a channel-defining portion for resiliently and grippingly engaging a corresponding conduit portion of the plumbing tree, and each bracket including affixing portions, remote from the channel-defining portion, for being affixed to the wall;

(c) the shell enclosure being pressed against the wall by attachment of the control knob securement means to the control valve, by attachment of the shower head fixture to an upper end of the first conduit, and by attachment of the tub spout to a lower end of the second conduit;

whereby the enclosure is secured to the wall by means of the plumbing assembly.

3. A modular shower unit as set forth in claim 2 wherein the channel-defining portion of each bracket including a notch, the affixing portions remote from the channel-defining portion being relatively movable by bending of the channel-defining portion, the channel-defining portion thereby effectively providing a hinge, the bending causing opening of said notch for receiving the corresponding conduit portion of the plumbing tree.

* * * * *